US005192237A

United States Patent [19]

Pegoraro

[11] Patent Number: 5,192,237

[45] Date of Patent: Mar. 9, 1993

[54] AQUATIC SKI WITH HUMAN PROPULSION GENERATED BY DEAMBULATORY ACTION

[76] Inventor: Paolo Pegoraro, Via Asolana 22, 31030 S. Vito Di Altivole (TV), Italy

[21] Appl. No.: 743,346

[22] PCT Filed: Feb. 12, 1990

[86] PCT No.: PCT/IT90/00015

§ 371 Date: Aug. 5, 1991

§ 102(e) Date: Aug. 5, 1991

[87] PCT Pub. No.: WO90/09310

PCT Pub. Date: Aug. 23, 1990

[30] Foreign Application Priority Data

Feb. 13, 1989 [IT] Italy ..... 82508 A/89

[51] Int. Cl.[5] ..... B63B 35/83

[52] U.S. Cl. ..... 441/76; 440/17; 440/21

[58] Field of Search ..... 440/13, 17, 19, 20, 440/21, 32; 441/76, 77

[56] References Cited

U.S. PATENT DOCUMENTS 3,833,956 9/1974 Meehan ..... 441/76

FOREIGN PATENT DOCUMENTS 3431665 4/1986 Fed. Rep. of Germany ..... 440/17

1527726 6/1968 France .

*Primary Examiner*—Edwin L. Swinehart

*Attorney, Agent, or Firm*—Harrison & Egbert

[57] ABSTRACT

An aquatic ski for human propulsion generated by deambulatory action having a floatable hull and a propulsive oscillating fin assembly. The fin assembly includes a foot seat pivotally connected to the hull and a movable fin in articulated and cooperative connection with the foot seat. The movable fin has a plurality of free oscillating vanes pivotally connected between a pair of parallel arms. The oscillating vanes are movable between a position aligned with the arms and a position transverse to the arms. The hull has a forward portion and a rearward portion pivotally connecting together. The hull includes flotation chambers forward and rearward of the foot seat.

5 Claims, 1 Drawing Sheet

AQUATIC SKI WITH HUMAN PROPULSION GENERATED BY DEAMBULATORY ACTION

TECHNICAL FIELD

The present invention relates to aquatic skis, in general. More particularly, the present invention relates to self-propulsive and self-supportive skis.

BACKGROUND ART

Aquatic ski of different gender, in which a first kind includes essentially two longitudinal floating elements being over each one a place for foot are instead known. The enlivening of said ski is made by the user who, acting with the arms movement imprints laterally a pushing force as floating rackets. Being this solution totally afunctional, in a further solution, the foot seat is substantially modified realizing an anterior hinging, of the kind of the usual on ground ski, allowing better utilization of muscular force and increased speed.

Further solution is disclosed in U.S. Pat. No. 3,833,956 (John F. Mehan) in which a water skate for each foot including a buoyant hull structure is disclosed. Each hull has a vertically pivotable foot support mounted within a well in the hull. Movement of the foot support actuates a lever arm which is fixedly secured to the foot support and extends rearwardly beneath the hull and terminates in a horizontally disposed blade. The blade reciprocates through the water as it is moved by the pivotal movement of the foot support and reacts with the water to provide forward movement of the hull on both the upward and downward motion.

This solution provides an efficient propulsion of advancement without needing advancement arm propulsion means, nevertheless, the proposed propulsion means are not so efficient providing an effective resistance in the respective movement of its propulsion blade.

FR-A1-2481939 (COMPARON JEAN DANIEL) discloses downwards fixed hinged blades acting like fish fins that oscillates from a position parallel to the bottom of the hull to a more or less inclined position to realize resistance in the water in rear direction, the apparatus being further inflatable and foldable by intermediate hinging in order to store it in a reduced dimension. This solution is simpler than the first one but the sole rearward movement is not sufficient to realize a real reaction in advancement, because a certain "Hysteresis" happens before the resistance realized by the open blades transmit their reaction. For this reasons such solutions have not satisfied the exigencies of an appreciable utilization.

SUMMARY OF THE INVENTION

The purpose of the present invention as claimed solves the problem realizing a symmetrical pair of aquatic ski movable by human propulsion, generated by deambulation (walking), each aquatic ski being inflatable and pliable, realizing each one a floating table to support hydrostatically and hydrodynamically the human weight and centrally supporting an end hinged foot articulated to an upper hinged oscillating movable fin propeller in order to give the necessary pushing for advancement for each aquatic ski including:

for one foot, a floating hull;

propulsive oscillating means associated with the respective hull, comprising an upper central oscillating foot seat cooperating and articulated to an intermediate hinged underlying movable fin means, said fin means being proportionally oscillating from upward position to downward horizontal position, adjacent to the respective hull characterized in that said propulsive oscillating fin means comprises a free pivotable oscillating vane means pivotable into a couple of oscillating parallel arms from a position aligned with said arms for causing resistance to advancement to a position free oscillating parallel to the flue of the passing water between them.

The advancement is so achieved by deambulation (walking) on the water allowing to across rivers and lagoons etc.

The advantages so achieved realize an extremely creative technical progress.

The pair of skis being pliable and inflatable are further easily transportable anywhere.

The easy walking facilitates aquatic excursions and widening, choosing any desired itinerary or trekking activity without obstruction by water barriers.

The idea is born by the ancient dream of the man to walk on the water and lacking at today suitable solutions to realize a good aquatic walking means. These and other advantages will appear from the successive specification with the enclosed drawings that represent a specified preferential solution of realization, the particulars of which being not to be considered limitative but exemplificative solely.

DETAILED DESCRIPTION OF THE INVENTION

As evidenced by the figures the floating, both in static phase and in dynamic phase, is assured by a special inflatable flexible hull of one ski (1) which shall respect three fundamental characteristics:

1—sustaining the weigh of a person even without advancing movement,

2—the hydrodynamic profile reduce the advancement resistance and

Figure 3:
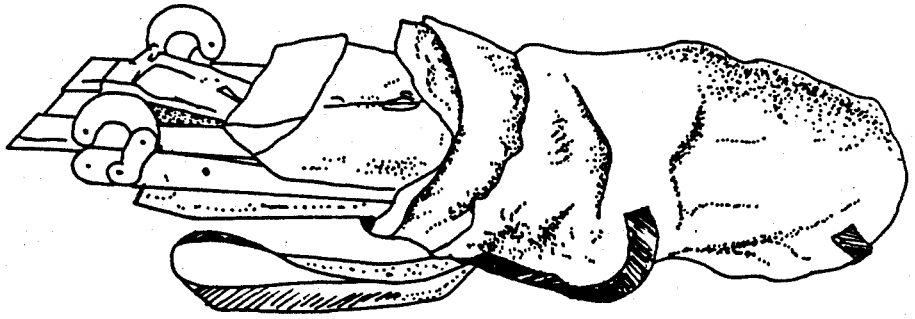
FIG. 3 represents a perspective view of a folded pair of aquatic skis packing, demonstrating the very compact ensemble.
Figure 1:
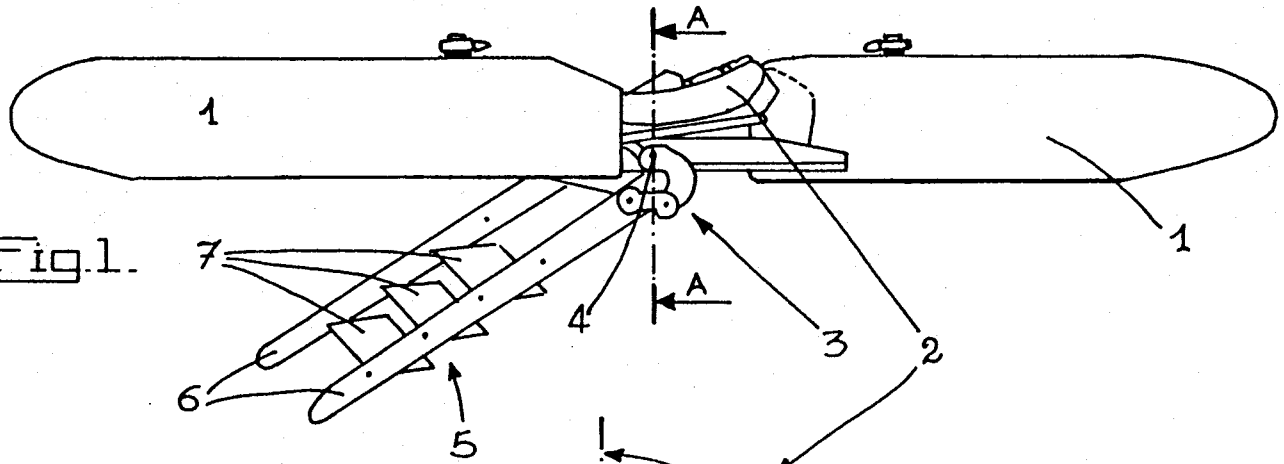
FIG. 1 represents a prospective view of only one ski of the walking pair, in opened and advancing position.

3—when the skis have been deflated and folded, the encumber is so reduced to allow easy storing in a walking rucksack (FIG. 3) expressly realized to simplify the transportation.

To satisfy the first exigency of the buoyancy (floating) in stop condition, the solution of the inflatable hull (1) has been chosen and to satisfy the second, the hydrodynamic profile has been chosen with central recession, coincident with the pushing hydrostatic center (section, A—A) wherein a niche that supports the oscillating foot seat propeller (2) is realized, this one being joined through (4), to a respective lever means (3) having the task to transmit the oscillatory motion to the downwards oscillating propeller fin.

The volume of the two floating hulls is configured so as to permit a static loaded phase. The hulls should be semi-immersed so as to enhance the ability to stand upwardly in the water. The barycenter of the hulls should be as low as possible. Only the upper portion of the hull extends outwardly from the water. By keeping the hull as low as possible in the water, the stability of the hull is enhanced. This also serves to avoid excessive and superfluous size.

Starting from the aforementioned considerations, it is possible to realize different sizes of the skis for different user weight.

The hydrodynamic shape can be directed between those already known and experimented giving better consideration to the hydrodynamic profiles not being important other particulars other than aesthetical and to be packageable.

The reduced encumber (FIG. 3), has the purpose to obtain an optimized stowing of the ski, even in a walking rucksack to allow easy transportation, for this reason both the hull of the skis have been divided in two jointed half portions, being in the jointing place the propulsion mechanic system placed, having a seat foot lever propeller (2) connected to a lever articulation means (4-3) for the propulsion mechanism. The two ski portions being foldable in that position by rotation of 180°.

The propulsion mechanism is a hinged oscillating movable fin (5).

The floating hull ski is built with rigid materials in the inferior part solely, being the hull only directly in contact with the surface of the water.

The hull has a lower portion that is completely rigid and sufficiently strong so as to withstand the forces that are imparted to the hull during its utilization. The hull has an upper portion which is inflatably deformable. The upper and lower portions may be formed completely with plastic materials. Such materials serve to reduce the weight and enhance the easy manageability of the device.

Figure 2:
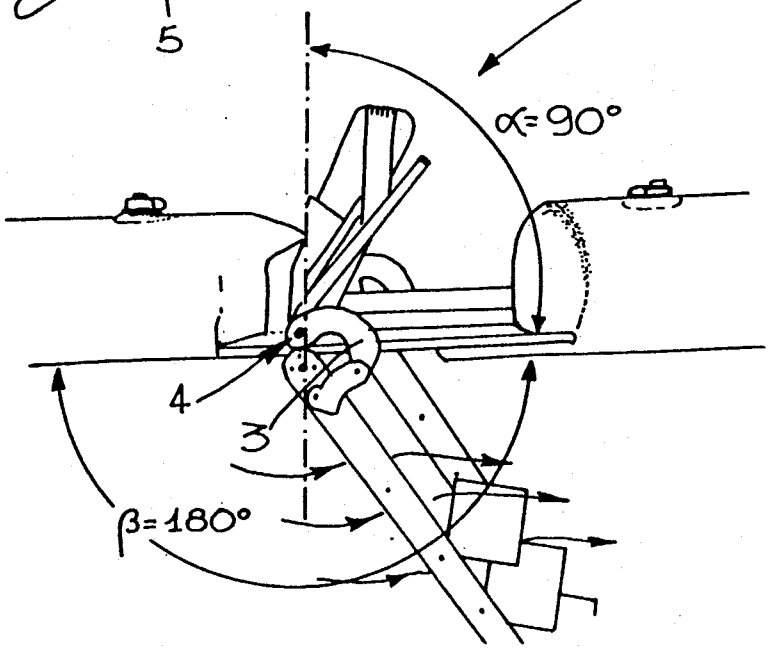
FIG. 2 represents a perspective view of the particular relating the propulsive device in upper position of the foot seat propeller, with the respective movable fin downstream oriented being visualized also the articulations connecting the movement of the foot seat propeller with the respective movable fin, this one having a one way oscillating pending vanes.

The propeller is realized by said rigid foot seat (2) pivoted on the spike (4) (FIG. 2) oscillating up and down, in the elicited recess in the center of the ski.

The oscillation that repeats roughly the path of the foot when is in stroke, is allowed by a natural angle that goes, starting from the rest upstanding position or with the plant of the rested foot on the bottom hull, to reach the maximum of the lifting of the heel to say forming a angle of about 90°.

This foot seat (2) is connected by said articulation lever means (3), to a pending oscillating fin having two paired arms (6) hingedly placed at one and at the other side of each single ski; allowing its oscillation going from the spike (in weight heel down action) to the tail of the hull (in recoiling advancement motion) covering an excursion angle of approximately 180°. This is roughly double the covered angle of the foot seat 2. This effect is obtained through a play of usual levers (3) referred and studied exactly for such purpose.

A plurality of free oscillating vanes (7) are pivoted between arms 6. The vanes (7) are free to oscillate between a position aligned with the arms (6) to a transverse position. This allows the vanes to be aligned with the upward oriented arms (6), in the ski advancing position, so as to form a unique resistance surface. Such a position of alignment occludes the passage of water. This allows the skis to be pushed and advanced. When the foot seat is lifted, the water resistance causes the vanes (7) to open to a position transverse to arms (6). The vanes remain open in a position in parallel relation to the flow of water therethrough. Upon recoil of the foot seat, the vanes are free to oscillate in conformity with water flow and without creating appreciate resistance. This motion is repeated so as to cause a "walking on water" effect.

I claim:

1. An aquatic ski for human propulsion generated by deambulatory action comprising:
   - a floatable hull;
   - a propulsive oscillating means connected to said floatable hull for causing movement of said floatable hull in response to the deambulatory action, said propulsive oscillating means comprising:
     - a foot seat positioned generally centrally in said hull, said foot seat angularly pivotable relative to said hull; and
     - a movable fin means in articulated and cooperative connection to said foot seat, said movable fin means angularly pivotable relative to said hull, said movable fin means comprising a plurality of free oscillating vanes pivotally connected between a pair of parallel arms, said oscillating vanes movable between a position aligned with said arms and a position transverse to said arms, said position transverse being parallel to a flow of water between adjacent vanes, said position aligned being occlusive to a flow of water between adjacent vanes.

2. The ski of claim 1, said hull comprises:
   - an underlying rigid longitudinal hull; and
   - an inflatable envelope connected to said rigid longitudinal hull, said inflatable envelope extending upwardly therefrom.

3. The ski of claim 2, said inflatable envelope having two chambers, one of said chambers positioned forward of said foot seat, another of said chambers positioned rearward of said foot seat.

4. The ski of claim 2, said rigid longitudinal hull having a first half portion and a second half portion, said first half portion hingedly connected to said second half portion along a central pivot of said hull, said first half portion foldable onto said second half portion.

5. An aquatic ski for human propulsion generated by deambulatory action comprising:
   - a floatable hull;
   - a propulsive oscillating means connected to said floatable hull for causing movement of said floatable hull in response to the deambulatory action, and propulsive oscillating means comprising:
     - a foot seat positioned generally centrally in said hull, said foot seat angularly pivotable relative to said hull;
     - a movable fin means in articulated and cooperative connection to said foot seat, said movable fin means angularly pivotable relative to said hull, said movable fin means connected to said foot seat such that angular movement of said foot seat causes a proportionately greater angular movement of said movable fin means.

* * * * *